US009899119B2

(12) United States Patent
Yoshida et al.

(10) Patent No.: US 9,899,119 B2
(45) **Date of Patent: *Feb. 20, 2018**

(54) ELECTRIC WIRE APPARATUS

(71) Applicants: Furukawa Electric Co., Ltd., Tokyo (JP); Furukawa Automotive Systems Inc., Shiga (JP)

(72) Inventors: Sho Yoshida, Tokyo (JP); Akira Tachibana, Tokyo (JP); Yasushi Kihara, Tokyo (JP); Shigeki Sekiya, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/464,110

(22) Filed: Mar. 20, 2017

(65) Prior Publication Data

US 2017/0194066 A1 Jul. 6, 2017

Related U.S. Application Data

(63) Continuation of application No. PCT/JP2015/076760, filed on Sep. 18, 2015.

(30) Foreign Application Priority Data

Sep. 22, 2014 (JP) ..... 2014-193082

(51) Int. Cl.
*H01B 1/02* (2006.01)
*C22C 21/08* (2006.01)
(Continued)

(52) U.S. Cl.
CPC ..... *H01B 1/023* (2013.01); *C22C 21/02* (2013.01); *C22C 21/08* (2013.01); *C22F 1/05* (2013.01);
(Continued)

(58) Field of Classification Search
USPC ..... 174/74 R; 428/372
See application file for complete search history.

(56) References Cited

U.S. PATENT DOCUMENTS 8,679,641 B2 * 3/2014 Saxton ..... B22F 7/08 419/10
9,263,167 B2 * 2/2016 Yoshida ..... C22C 21/02
(Continued)

FOREIGN PATENT DOCUMENTS

JP 5155464 B2 3/2012
JP 2012229485 A 11/2012
(Continued)

OTHER PUBLICATIONS

International Preliminary Report on Patentability dated Mar. 28, 2017 for appln No. PCT/JP2015/076760 (Engl translation).
(Continued)

*Primary Examiner* — William H Mayo, III
*Assistant Examiner* — Krystal Robinson
(74) *Attorney, Agent, or Firm* — Dorsey & Whitney LLP

(57) ABSTRACT

An electric wire apparatus includes an electric wire including an aluminum alloy wire rod having an outer periphery portion coated, and a crimp terminal crimped to an end portion of the electric wire, the crimp terminal having a barrel portion crimped with the aluminum alloy wire rod, the barrel portion having a one-end closed tubular shape. The aluminum alloy wire rod has a composition including 0.10 mass % to 1.00 mass % of magnesium (Mg), 0.10 mass % to 1.00 mass % of silicon (Si), 0.01 mass % to 2.50 mass %
(Continued)

of iron (Fe), 0.000 mass % to 0.100 mass % of titanium (Ti), 0.000 mass % to 0.030 mass % of boron (B), 0.00 mass % to 1.00 mass % of copper (Cu), 0.00 mass % to 0.50 mass % of silver (Ag), 0.00 mass % to 0.50 mass % of gold (Au), 0.00 mass % to 1.00 mass % of manganese (Mn), 0.00 mass % to 1.00 mass % of chromium (Cr), 0.00 mass % to 0.50 mass % of zirconium (Zr), 0.00 mass % to 0.50 mass % of hafnium (Hf), 0.00 mass % to 0.50 mass % of vanadium (V), 0.00 mass % to 0.50 mass % of scandium (Sc), 0.00 mass % to 0.50 mass % of cobalt (Co), 0.00 mass % to 0.50 mass % of nickel (Ni), and the balance including aluminum and inevitable impurities.

7 Claims, 3 Drawing Sheets

(51) Int. Cl.

| | |
|---|---|
| ***C22C 21/02*** | (2006.01) |
| ***C22F 1/05*** | (2006.01) |
| ***H01B 13/00*** | (2006.01) |
| ***H01B 13/02*** | (2006.01) |
| ***H01B 13/06*** | (2006.01) |
| ***H01B 7/282*** | (2006.01) |
| ***H01R 4/18*** | (2006.01) |

(52) U.S. Cl.
CPC ..... *H01B 7/282* (2013.01); *H01B 13/0003* (2013.01); *H01B 13/0016* (2013.01); *H01B 13/02* (2013.01); *H01B 13/06* (2013.01); *H01R 4/18* (2013.01)

(56) References Cited

U.S. PATENT DOCUMENTS

| | | | | |
|---|---|---|---|---|
| 9,263,168 | B2 * | 2/2016 | Sekiya | C22C 21/02 |
| 9,422,612 | B2 * | 8/2016 | Kusakari | C22C 21/02 |
| 2006/0013719 | A1 * | 1/2006 | Ichikawa | C22C 21/10 419/29 |
| 2007/0221396 | A1 * | 9/2007 | Izumida | C21D 8/06 174/128.1 |
| 2010/0059151 | A1 * | 3/2010 | Iwamura | C22C 21/12 148/690 |
| 2012/0321889 | A1 | 12/2012 | Sekiya et al. | |
| 2013/0264115 | A1 * | 10/2013 | Kobayashi | H01B 1/023 174/72 A |
| 2015/0007910 | A1 | 1/2015 | Sekiya et al. | |

FOREIGN PATENT DOCUMENTS

| | | | |
|---|---|---|---|
| JP | 2013080682 | A | 5/2013 |
| WO | 2011105584 | A1 | 9/2011 |
| WO | 2013147270 | A1 | 10/2013 |

OTHER PUBLICATIONS

Written Opinion dated Dec. 22, 2015 for appln No. PCT/JP2015/076760 (Engl translation).
ISR/WO dated Dec. 22, 2015 for appln No. PCT/JP2015/076760 (with Engl translation of ISR).

* cited by examiner

ELECTRIC WIRE APPARATUS

CROSS REFERENCE TO RELATED APPLICATIONS

This is a continuation application of International Patent Application No. PCT/JP2015/076760 filed Sep. 18, 2015, which claims the benefit of Japanese Patent Application No. 2014-193082, filed Sep. 22, 2014, the full contents of all of which are hereby incorporated by reference in their entirety.

BACKGROUND

Technical Field

The present disclosure relates to an electric wire with terminal in which an aluminum alloy wire rod is used.

Background

In the related art, an electric wire with terminal is used as an electric wiring structure for transportation vehicles such as automobiles, trains, and aircrafts, or an electric wiring structure for industrial robots. The electric wire with terminal is a member including an electric wire having a conductor made of copper or copper alloy and fitted with a terminal (connector) made of copper or copper alloy (e.g., brass).

With recent rapid advancements in performances and functions of automobiles, various electrical devices and control devices installed in vehicles tend to increase in number and electric wiring structures used for devices also tends to increase in number. On the other hand, for environmental friendliness, lightweighting is strongly desired to improve fuel efficiency of transportation vehicles such as automobiles.

As one of the measures for achieving recent lightweighting of transportation vehicles, there have been, for example, studies in changing the conductor of an electric wiring structure from the conventionally used copper or a copper alloy into aluminum or an aluminum alloy which is more lightweight. Since aluminum has a specific gravity of about one-third of a specific gravity of copper and has a conductivity of about two-thirds of a conductivity of copper (in a case where pure copper is a standard for 100% IACS, pure aluminum has approximately 66% IACS), a pure aluminum conductor wire rod needs to have a cross sectional area of approximately 1.5 times greater than that of a pure copper conductor wire rod to allow the same electric current as the electric current flowing through the pure copper conductor wire rod to flow through the pure aluminum conductor wire rod. Even an aluminum conductor wire rod having an increased cross section as described above is used, using an aluminum conductor wire rod is advantageous from the viewpoint of lightweighting, since an aluminum conductor wire rod has a mass of about half the mass of a pure copper conductor wire rod. Note that, "% IACS" represents a conductivity when a resistivity $1.7241\times10^{-8}$ Ωm of International Annealed Copper Standard is taken as 100% IACS.

However, it is known that pure aluminum, typically an aluminum alloy for transmission lines (JIS (Japanese Industrial Standard) A1060 and A1070), is generally poor in its durability to tension, resistance to impact, and bending characteristics. Therefore, for example, it cannot withstand a load abruptly applied by an operator or an industrial device while being installed to a car body, a tension at a crimp portion of a connecting portion between an electric wire and a terminal, and a cyclic stress loaded at a bending portion such as a door portion. On the other hand, an alloyed material containing various additive elements added thereto is capable of achieving an increased tensile strength, but a conductivity may decrease due to a solution phenomenon of the additive elements into aluminum, and because of excessive intermetallic compounds formed in aluminum, a wire break due to the intermetallic compounds may occur during wire drawing. Therefore, it is essential to limit or select additive elements to provide a sufficient elongation property to prevent a wire break, and it is further necessary to improve impact resistance and bending characteristics while ensuring a conductivity and a tensile strength equivalent to those in the related art.

For example, Japanese Laid-Open Patent Publication No. 2012-229485 discloses a typical aluminum conductor used for an electric wiring structure of the transportation vehicle. This is an extra fine wire that can provide an aluminum alloy wire rod and an aluminum alloy stranded wire having a high strength and a high conductivity, as well as an improved elongation. Also, Japanese Laid-Open Patent Publication No. 2012-229485 discloses that elongation is sufficient, which results in improved bending characteristics. However, for example, it is neither disclosed nor suggested to use an aluminum alloy wire as a wire harness attached to a door portion, and there is no disclosure or suggestion about bending fatigue resistance under an operating environment in which a high cycle fatigue fracture is likely to occur due to repeated bending stresses applied by opening and closing of the door.

Recently, it is being recognized that, when manufacturing an aluminum alloy wire rod used for automobiles, particularly an aluminum alloy wire rod of about φ 0.1 mm to φ 1.5 mm, the following three problems arise. The first problem is that, when used for a repeatedly bent section such as a door section of an automobile as described above, a high bending fatigue resistance is required. Since aluminum has a poor bending fatigue characteristic as compared to that of copper, an applicable place is limited. The second problem is that, because of a high proof stress, a large force is required when attaching a wire harness, and thus a working efficiency is low. The third problem is that, because of a low elongation property, it cannot withstand an impact while installing the wire harness or after installing the wire harness, and thus a wire break or a crack occurs. In order to solve all of these problems, provided that conductivity is high, an aluminum alloy wire having a high bending fatigue resistance as well as an appropriate proof stress and a high elongation property is necessary.

As aluminum alloys having both high strength and high conductivity, alloy in which Mg and Si, Cu, Mn or the like are added are known. For example, according to Japanese Patent No. 5155464, these elements are added to achieve a tensile strength of greater than or equal to 150 MPa and a conductivity of greater than or equal to 40%. Further, according to Japanese Patent No. 5155464, by manufacturing a wire rod having a maximum grain size of less than or equal to rod 50 μm, an elongation property of greater than or equal to 5% is achieved at the same time.

However, the aluminum alloy wire rod according to Japanese Patent No. 5155464 is not capable of achieving both high conductivity and a high elongation property as well as both high bending fatigue resistance and an appropriate proof stress, and thus the above-mentioned three problems cannot be solved simultaneously.

An automotive wire harness or the like generally employs an electric wire with terminal including a crimp terminal of copper or a copper alloy fitted at an end portion of a coated wire having a wire rod of a copper alloy conductor as a base, but when the above mentioned wire rod is replaced with an aluminum alloy, a problem of corrosion due to a potential difference arises.

In this regards, recently, there is a development in a technique for solving the problem of corrosion. Using a terminal including a one end closed barrel portion, a connecting portion between the wire rod and the terminal is formed in the barrel portion, and the barrel portion is crimped so that moisture does not enter into the barrel portion. However, conventionally, a relatively soft material such as pure aluminum is used as a wire rod, and when crimping an electric wire (i.e., when a crimp force is applied from an outer peripheral portion of the wire rod), the wire rod of such a material tends to extend in a longitudinal direction and escape, rather than producing deformation that is repulsive in a plane perpendicular to the longitudinal direction.

Therefore, it was not possible to suppress a void fraction in the barrel portion at a low level, and water was likely to enter inside. Accordingly, in a case of a copper terminal, it was a cause of corrosion between dissimilar metals.

Also, inside the one end closed tubular barrel portion, a tip of the aluminum alloy wire rod abuts an inner wall surface of the barrel portion at a leading end side. Accordingly, there may be cases where a desired crimping property and a water-proof property cannot be obtained by the barrel portion. For example, a part of the barrel portion that is weak in strength may break, or an entire electric wire may be pushed back towards a rear end side with respect to the terminal, and an aluminum alloy wire rod without a coating may be exposed from an opening portion of the barrel. Further, crimping of a resin portion of the electric wire may be insufficient, which may decrease a pull out strength.

In order to prevent this, for example, a space elongated in a longitudinal direction may be provided inside the barrel portion to take into account a possible elongation amount of the aluminum alloy wire rod. However, in such a case, the entire terminal becomes excessively long in the longitudinal direction.

Here, a connector housing provided on a wire harness is designed to have a shape, size, etc., assuming that a terminal comprising copper or a copper alloy is to be inserted. Therefore, in order to accommodate a terminal in a housing, it is necessary to place, particularly, a longitudinal length of the terminal within a predetermined range. However, in a case where the barrel portion as described above becomes excessively long in a longitudinal direction, there was a problem that a rear end of the terminal projects from the connector housing.

The present disclosure is related to providing an electric wire with terminal including a terminal having a one-end closed barrel portion and an electric wire including an aluminum alloy wire rod, in which the aluminum alloy wire rod has, while maintaining an elongation property and conductivity that are equivalent or greater than those of conventional products, both an appropriate proof stress and a high bending fatigue resistance, and in which moisture is less likely to enter inside the barrel portion, and also the terminal can be configured to have a compact structure in the longitudinal direction.

The inventors have found that, when an aluminum alloy wire rod is bent, a stress produced in an outer peripheral portion of a conductor is greater than a stress produced at a central portion, and a crack was likely to occur in an outer peripheral surface. Accordingly, the inventors have focused on a case in which, when an aluminum alloy has a small crystal grain size, a crack encounters a grain boundary for an increased number of times and a propagation speed decreases, and carried out assiduous studies. As a result, the inventors have reached the findings that, with an average crystal grain size at the outer peripheral part of the aluminum alloy wire rod being a value within a predetermined range, while maintaining a high conductive property, a bending fatigue resistance is improved, and further, an appropriate proof stress and a high elongation property are obtained.

Still further, the inventors have found that, under a crimping force from an outer periphery, an aluminum alloy wire rod as described above does not escape in a longitudinal direction like pure aluminum, but rather deforms isotropically. This implies that, when crimped at the barrel portion of the terminal, an aluminum alloy wire rod as described above repulses isotropically in a cross section subjected to the crimping force, in other words, less likely to escape in a longitudinal direction.

From the foregoing studies, the inventors have found that, the aforementioned aluminum alloy wire rod is, when in combination with a terminal having a one-end closed tubular barrel portion, an aluminum alloy wire rod suitable for controlling an elongation of the electric wire in a predetermined range when crimping the barrel portion, and thus an electric wire with terminal suitable for an automotive wire harness can be obtained.

SUMMARY

According to an aspect of the present disclosure, an electric wire apparatus includes: an electric wire including an aluminum alloy wire rod having an outer periphery portion coated; and a crimp terminal that is crimped to an end portion of the electric wire, the crimp terminal having a barrel portion that is crimped with the aluminum alloy wire rod, the barrel portion having a one end closed tubular shape, the aluminum alloy wire rod having a composition including 0.10 mass % to 1.00 mass % of magnesium (Mg), 0.10 mass % to 1.00 mass % of silicon (Si), 0.01 mass % to 2.50 mass % of iron (Fe), 0.000 mass % to 0.100 mass % of titanium (Ti), 0.000 mass % to 0.030 mass % of boron (B), 0.00 mass % to 1.00 mass % of copper (Cu), 0.00 mass % to 0.50 mass % of silver (Ag), 0.00 mass % to 0.50 mass % of gold (Au), 0.00 mass % to 1.00 mass % of manganese (Mn), 0.00 mass % to 1.00 mass % of chromium (Cr), 0.00 mass % to 0.50 mass % of zirconium (Zr), 0.00 mass % to 0.50 mass % of hafnium (Hf), 0.00 mass % to 0.50 mass % of vanadium (V), 0.00 mass % to 0.50 mass % of scandium (Sc), 0.00 mass % to 0.50 mass % of cobalt (Co), 0.00 mass % to 0.50 mass % of nickel (Ni), and the balance including aluminum and inevitable impurities.

According to an electric wire apparatus of the present disclosure, an electric wire apparatus including a terminal having a one-end closed barrel portion and an electric wire including an aluminum alloy wire rod is provided, in which the aluminum alloy wire rod has, while maintaining an elongation property and a conductivity that are equivalent or greater than those of conventional products, an appropriate proof stress and a high bending fatigue resistance, and in which moisture is likely to enter inside the barrel portion, and also the terminal can be configured to have a compact structure in a longitudinal direction.

In other words, the aluminum alloy wire of the present disclosure has a conductivity equivalent to or greater than that of a conventional aluminum alloy wire, and thus the aluminum alloy wire of the present disclosure is useful as a battery cable, a wire harness or a conductor wire for a motor, each of which configured to be equipped in a transportation vehicle.

Further, the aluminum alloy wire rod has, in particular, a high bending fatigue resistance, and thus can be used at a bending portion for which a high bending fatigue resistance is required, such as a door portion and a trunk. Further, since the aluminum alloy wire rod has an appropriate proof stress, a wire harness can be attached with a small external force and a working efficiency improves. Further, the aluminum alloy wire rod has an elongation property equivalent to or greater than that of the conventional aluminum alloy wire rod, and thus can withstand an impact during the attaching of a wire harness or after the installation, and occurrence of a wire break or a crack can be reduced.

In addition, the elongation is an isotropic elongation that is different from that of pure aluminum, and the aluminum alloy wire deforms so as to be repulsive against a crimping force of the barrel portion of the terminal, and ingress of moisture into the barrel portion can be prevented.

BRIEF DESCRIPTION OF DRAWINGS

In addition, the elongation is an isotropic elongation that is different from that of pure aluminum, and the aluminum alloy wire deforms so as to be repulsive against a crimping force of the barrel portion of the terminal, and ingress of moisture into the barrel portion can be prevented.

DETAILED DESCRIPTION (Basic Structure of an Electric Wire with Terminal of the Present Embodiment)

An electric wire with terminal of an embodiment of the present disclosure (hereinafter referred to as the present embodiment) will be described.

(1) Electric Wire with Terminal

Figures 1A, 1B:
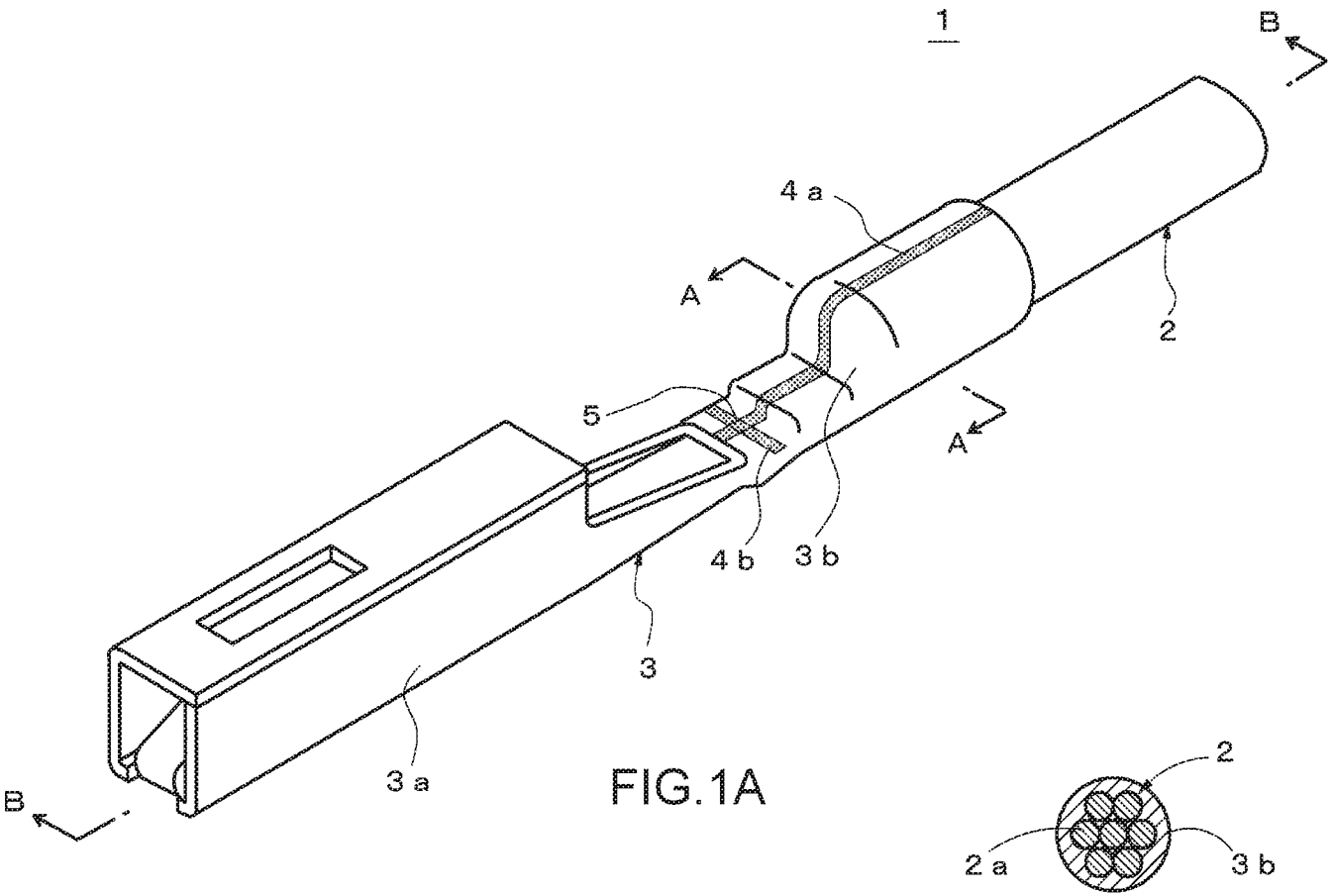
FIG. 1A is a perspective view schematically showing a structure of an electric wire with terminal according to an embodiment of the present disclosure.
FIG. 1B is a transverse cross-sectional view taken along line A-A in FIG. 1A.

As shown in FIGS. 1A and 1B, an electric wire with terminal 1 is provided with an electric wire 2 and a terminal 3 attached to an end portion of the electric wire.

The electric wire 2 includes an aluminum alloy wire rod 2*a* (here, a plurality of wire rods stranded together) and a resin coating layer 2*b* that coats an outer periphery of the aluminum alloy wire rod 2*a*. The electric wire 2 is formed by applying a coating composed of resin on a single aluminum alloy conductor or a plurality of aluminum alloy conductors stranded together. In the present embodiment, the aluminum alloy wire rod 2*a* is composed of Al—Mg—Si based alloy.

The terminal 3 is, for example, a female terminal, and includes a connecting portion 3*a* having a box shape and configured to allow insertion of an insertion tab or the like of a male terminal, and a one-end closed tubular barrel portion 3*b*. The barrel portion 3*b* is formed into a tube shape that is closed at one end by, for example, welding. Specifically, a metal substrate that is developed into a planar geometry is pressed three-dimensionally to form a tubular body having a generally C-shaped cross section, and an open portion (butted portion) of the tubular body is laser welded. Since welding is performed along a longitudinal direction of a tubular body, a welded portion 4*a* (welded bead) is formed in a direction that is substantially identical to the longitudinal direction by butt welding. Further, subsequently, a leading end side of the barrel portion 3*b* is sealed by forming a welded portion 4*b* in a direction perpendicular to the longitudinal direction of the tubular body to form the barrel portion 3*b* into a one-end closed tubular shape. Here, a welded overlapped portion 5 which is a portion where the welded portion 4*a* and the welded portion 4*b* are joined is formed. By this sealing, moisture is prevented from entering into the barrel portion 3*b* from the connecting portion 3*a* side.

A description is now made of the aluminum alloy wire rod 2*a* which is characteristic in the present embodiment.

(2) Aluminum Alloy Wire Rod

The aluminum alloy wire rod 2*a* is an aluminum alloy wire rod having a composition consisting of or comprising 0.10 mass % to 1.00 mass % Mg; 0.10 mass % to 1.00 mass % Si; 0.01 mass % to 2.50 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.5 mass % Co; 0.00 mass % to 0.50 mass % Ni; and the balance being Al and inevitable impurities, wherein an average crystal grain size at an outer peripheral portion of the aluminum alloy wire rod 2*a* is 1 m to 35 μm, and an average crystal grain size at an inner portion is greater than or equal to 1.1 times the average crystal grain size at the outer peripheral portion.

Hereinafter, reasons for limiting chemical compositions or the like of the aluminum alloy wire rod 2*a* of the present embodiment will be described.

(3-1) Chemical Composition

<Mg: 0.10 mass % to 1.00 mass %>

Mg (magnesium) is an element having a strengthening effect by forming a solid solution with an aluminum matrix and a part thereof having an effect of improving a tensile strength, a bending fatigue resistance and a heat resistance by being combined with Si to form precipitates. However, in a case where Mg content is less than 0.10 mass %, the above effects are insufficient. In a case where Mg content exceeds 1.00 mass %, there is an increased possibility that a Mg-concentration part will be formed on a grain boundary, thus resulting in decreased tensile strength, elongation, and bending fatigue resistance, as well as a reduced conductivity due to an increased amount of Mg element forming the solid solution. Accordingly, the Mg content is 0.10 mass % to 1.00 mass %. The Mg content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Si: 0.10 mass % to 1.00 mass %>

Si (silicon) is an element that has an effect of improving a tensile strength, a bending fatigue resistance and a heat resistance by being combined with Mg to form precipitates. However, in a case where Si content is less than 0.10 mass %, the above effects are insufficient. In a case where Si content exceeds 1.00 mass %, there is an increased possibility that an Si-concentration part will be formed on a grain boundary, thus resulting in decreased tensile strength, elongation, and bending fatigue resistance, as well as a reduced conductivity due to an increased amount of Si element forming the solid solution. Accordingly, the Si content is 0.10 mass % to 1.00 mass %. The Si content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Fe: 0.01 mass % to 2.50 mass %>

Fe (iron) is an element that contributes to refinement of crystal grains mainly by forming an Al—Fe based intermetallic compound and provides improved tensile strength and bending fatigue resistance. Fe dissolves in Al only by 0.05 mass % at 655° C. and even less at room temperature. Accordingly, the remaining Fe that could not dissolve in Al will be crystallized or precipitated as an intermetallic compound such as Al—Fe, Al—Fe—Si, and Al—Fe—Si—Mg. This intermetallic compound contributes to refinement of crystal grains and provides improved tensile strength and bending fatigue resistance. Further, Fe has, also by Fe that has dissolved in Al, an effect of providing an improved tensile strength. In a case where Fe content is less than 0.01 mass %, those effects are insufficient. In a case where Fe content exceeds 2.50 mass %, a wire drawing workability worsens due to coarsening of crystallized materials or precipitates and a wire break is likely to occur during wire drawing. In addition, a target bending fatigue resistance cannot be achieved and a conductivity decreases. Therefore, Fe content is 0.01 mass % to 2.50 mass %, and preferably 0.15 mass % to 0.90 mass %, and more preferably 0.15 mass % to 0.45 mass %. It is to be noted that, when Fe is excessive, a wire drawing workability worsens due to coarsening of crystallized materials or precipitates, and as a result, a wire break is likely to occur. However, with the present embodiment, a reduction ratio per pass is less than or equal to 10%, which is low, and thus a tensile force during wire drawing is suppressed and a wire break is less likely to occur. Accordingly, a greater amount of Fe can be contained, and up to 2.50 mass % can be contained.

The aluminum alloy wire rod 2*a* of the present embodiment includes Mg, Si and Fe as essential components, and may further contain at least one selected from a group consisting of Ti and B, and/or at least one selected from a group consisting of Cu, Ag, Au, Mn, Cr, Zr, Hf, V, Sc, Co and Ni, as necessary.

<Ti: 0.001 mass % to 0.100 mass %>

Ti is an element having an effect of refining the structure of an ingot during dissolution casting. In a case where an ingot has a coarse structure, the ingot may crack during casting or a wire break may occur during a wire rod processing step, which is industrially undesirable. In a case where Ti content is less than 0.001 mass %, the aforementioned effect cannot be achieved sufficiently, and in a case where Ti content exceeds 0.100 mass %, the conductivity tends to decrease. Accordingly, the Ti content is 0.001 mass % to 0.100 mass %, preferably 0.005 mass % to 0.050 mass %, and more preferably 0.005 mass % to 0.030 mass %.

<B: 0.001 mass % to 0.030 mass %>

Similarly to Ti, B is an element having an effect of refining the structure of an ingot during dissolution casting. In a case where an ingot has a coarse structure, the ingot may crack during casting or a wire break is likely to occur during a wire rod processing step, which is industrially undesirable. In a case where B content is less than 0.001 mass %, the aforementioned effect cannot be achieved sufficiently, and in a case where B content exceeds 0.030 mass %, the conductivity tends to decrease. Accordingly, the B content is 0.001 mass % to 0.030 mass %, preferably 0.001 mass % to 0.020 mass %, and more preferably 0.001 mass % to 0.010 mass %.

To contain at least one selected from a group consisting of <Cu: 0.01 mass % to 1.00 mass %>, <Ag: 0.01 mass % to 0.50 mass %>, <Au: 0.01 mass % to 0.50 mass %>, <Mn: 0.01 mass % to 1.00 mass %>, <Cr: 0.01 mass % to 1.00 mass %>, <Zr: 0.01 mass % to 0.50 mass %>, <Hf: 0.01 mass % to 0.50 mass %>, <V: 0.01 mass % to 0.50 mass %>, <Sc: 0.01 mass % to 0.50 mass %>, <Co: 0.01 mass % to 0.50 mass %>, and <Ni: 0.01 mass % to 0.50 mass %>.

Each of Cu, Ag, Au, Mn, Cr, Zr, Hf, V, Sc, Co and Ni is an element having an effect of refining crystal grains, and Cu, Ag and Au are elements further having an effect of increasing a grain boundary strength by being precipitated at a grain boundary. In a case where at least one of the elements described above is contained by 0.01 mass % or more, the aforementioned effects can be achieved and a tensile strength, an elongation, and a bending fatigue resistance can be further improved. On the other hand, in a case where any one of Cu, Ag, Au, Mn, Cr, Zr, Hf, V, Sc, Co and Ni has a content exceeding the upper limit thereof mentioned above, a conductivity tends to decrease. Therefore, ranges of contents of Cu, Ag, Au, Mn, Cr, Zr, Hf, V, Sc, Co and Ni are the ranges described above, respectively.

The more the contents of Fe, Ti, B, Cu, Ag, Au, Mn, Cr, Zr, Hf, V, Sc, Co and Ni, the lower the conductivity tends to be and the more the wire drawing workability tends to deteriorate. Therefore, it is preferable that a sum of the contents of the elements is less than or equal to 2.50 mass %. With the aluminum alloy wire rod 2*a* of the present embodiment, since Fe is an essential element, the sum of contents of Fe, Ti, B, Cu, Ag, Au, Mn, Cr, Zr, Hf, V, Sc, Co and Ni is 0.01 mass % to 2.50 mass %. It is further preferable that the sum of contents of these elements is 0.10 mass % to 2.50 mass %.

In order to improve the tensile strength, the elongation, and the bending fatigue resistance while maintaining a high conductivity, the sum of contents of Fe, Ti, B, Cu, Ag, Au, Mn, Cr, Zr, Hf, V, Sc, Co and Ni is particularly preferably 0.10 mass % to 0.80 mass %, and further preferably 0.20 mass % to 0.60 mass %. On the other hand, in order to further improve the tensile strength, the elongation, and the bending fatigue resistance, although the conductivity will slightly decrease, it is particularly preferably more than 0.80 mass % to 2.50 mass %, and further preferably 1.00 mass % to 2.50 mass %.

<Balance: Al and Inevitable Impurities>

The balance, i.e., components other than those described above, includes Al (aluminum) and inevitable impurities. Herein, inevitable impurities means impurities contained by an amount which could be contained inevitably during the manufacturing process. Since inevitable impurities could cause a decrease in conductivity depending on a content thereof, it is preferable to suppress the content of the inevitable impurities to some extent considering the decrease in the conductivity. Components that may be inevitable impurities include, for example, Ga, Zn, Bi, and Pb.

(3-2) Average Crystal Grain Size in Outer Peripheral Portion of Aluminum Alloy Wire Rod 2*a* is 1 μm to 35 μm An outer peripheral portion as used in the present embodiment refers to a region of the aluminum alloy wire rod 2*a* that includes an outer edge of the aluminum alloy wire rod 2*a* and a vicinity of the outer edge. In the case of the aluminum alloy wire rod 2*a* having a circular shape in a cross section perpendicular to a wire drawing direction, the outer peripheral portion refers to a region including an outer edge of the aluminum alloy wire rod 2*a* and having a width of 1/10 of a diameter of the aluminum alloy wire rod 2*a* from the outer edge. In a case of the aluminum alloy wire rod 2*a* having a cross section that is not circular, such as a compressed stranded wire, at first, a circle equivalent diameter is determined from the cross section of the aluminum alloy wire rod 2*a*. In this case, the outer peripheral portion is a region including an outer edge of the aluminum alloy wire rod 2*a* and having a width of 1/10 of a circle equivalent diameter of the aluminum alloy wire rod 2*a* from the outer edge.

In the present embodiment, an average crystal grain size at the outer peripheral portion is 1 μm to 35 μm. In a case where an average crystal grain size is less than 1 m, a proof stress is excessive and an elongation decreases. In a case where an average crystal grain size is greater than 35 μm, a bending fatigue resistance and a proof stress decrease. Therefore, the average crystal grain size at the outer peripheral portion is 1 μm to 35 μm, and preferably 3 μm to 30 μm, and more preferably 5 μm to 20 μm.

In a portion other than the outer peripheral portion of the aluminum alloy wire rod 2*a*, in other words, in an inner portion, an average crystal grain size is 1 μm to 90 μm. In a case where an average crystal grain size of the inner portion is less than 1 m, a proof stress is excessive and an elongation decreases, and in a case where an average crystal grain size of the inner portion is greater than 90 μm, a sufficient elongation and proof stress cannot be obtained. The average crystal grain size of the present embodiment was observed with an optical microscope, and measured using a crossover method.

(Manufacturing Method of the Aluminum Alloy Wire Rod 2*a* of the Present Embodiment)

The aluminum alloy wire rod 2*a* of the present embodiment can be manufactured through each of the processes including [1] a melting process, [2] a casting process, [3] a hot or cold working, [4] a first wire drawing process, [5] intermediate heat treatment, [6] a second wire drawing process, [7] solution heat treatment and a first strain process, [8] stranding process, [9] aging heat treatment and a second strain process. Note that a step of stranding wires or a step of coating an electric wire with resin may be provided before or after the second heat treatment or after the aging heat treatment.

Hereinafter, steps of [1] to [9] will be described.

[1] Melting Process

Melting is performed with such quantities providing concentrations of respective embodiments of the aluminum alloy composition to be described below.

[2] Casting, [3] Hot or Cold Working

Using a Properzi-type continuous casting rolling mill which is an assembly of a casting shaft and a belt, molten metal is cast with a water-cooled mold and continuously rolled to obtain a bar. Here, the bar has a size, for example, φ5.0 mm to φ13.0 mm. A cooling rate during casting at this time is, in regard to preventing coarsening of Fe-based crystallized products and preventing a decrease in conductivity due to forced solid solution of Fe, preferably 1° C./sec to 20° C./sec, but it is not limited thereto. Casting and hot rolling may be performed by billet casting and an extrusion technique.

[4] First Wire Drawing Process

Subsequently, the surface is stripped and the bar is made into a size of, for example, (5.0 mm to φ 12.5 mm, and wire drawing is performed by die drawing using a first die. By this wire drawing process, a diameter of a work piece is, for example, reduced to φ 2.0 mm. It is preferable that the die has a die half angle α of 10° to 30°, and a reduction ratio per pass is less than or equal to 10%. The reduction ratio is obtained by dividing a difference in cross section before and after the wire drawing by the original cross section and multiplying by 100. However, the reduction ratio is preferably greater than or equal to 1%, since the number of times of wire drawing for processing into a target wire size increases and productivity decreases, if the reduction ratio is extremely small. Also, when the reduction ratio is greater than 10%, since the wire drawing process is likely to become uniform inside and outside the wire rod, it is difficult to produce a difference in grain size at the outer peripheral portion and the inner portion, and there is a tendency that the proof stress cannot be reduced appropriately and the elongation cannot be improved. Further, providing an appropriate surface roughness to a tapered surface of the first die is advantageous in that treatment can be applied on a surface of a work piece during this wire drawing process. In this first wire drawing process, the stripping of the bar surface is performed first, but the stripping of the bar surface does not need to be performed.

[5] Intermediate Heat Treatment

Subsequently, an intermediate heat treatment is applied on the cold-drawn work piece. In the intermediate heat treatment of the present disclosure, the heating temperature of an intermediate annealing is 250° C. to 450° C., and the heating time is from ten minutes to six hours. If the heating temperature is lower than 250° C., a sufficient softening cannot be achieved and deformation resistance increases, and thus a wire break and a surface flaw are likely to occur during wire drawing. If it is higher than 450° C., coarsening of the crystal grains is likely to occur, and the elongation and the strength (proof stress or tensile strength) will decrease.

[6] Second Wire Drawing Process

Further, wire drawing of the work piece is performed by die drawing using a second die. By this wire drawing, an outer diameter of the work piece is reduced to, for example, φ 0.31 mm. It is preferable that the second die has a die half angle β of 10° to 30°, and a reduction ratio per pass is less than or equal to 10%. When the die half angle is in a range described above, it is advantageous in that a surface reduction ratio is increased, and it is possible to process the outer peripheral portion only. Also, it is desirable to increase the stress on the surface by roughening the tapered surface in the first wire drawing step, and to smooth the tapered surface to prevent occurrence of surface flaws and cracks in the second wire drawing step. Thus, making a surface roughness of a tapered surface of the second die smaller than a surface roughness of a tapered surface of the first die is advantageous in that it is possible to decrease merely the crystal grain size at the outer peripheral portion, without producing surface flaws.

[7] Solution Heat Treatment (First Heat Treatment) and First Strain Processing

Subsequently, a solution heat treatment as well as first strain processing is applied to the work piece. This solution heat treatment is performed for a purpose such as dissolving Mg, Si compounds randomly contained in the work piece into a matrix of an aluminum alloy. The first heat treatment is a heat treatment including heating to a predetermined temperature in a range of 480° C. to 620° C. and thereafter cooling at an average cooling rate of greater than or equal to 10° C./s to a temperature of at least to 150° C. When a solution heat treatment temperature is lower than 480° C., solution treatment will be incomplete, and acicular $Mg_2Si$ precipitates that precipitate during an aging heat treatment in a post-processing decreases, and degrees of improvement of the proof stress, the tensile strength, the bending fatigue resistance, and the conductivity become smaller. When solution heat treatment is performed at a temperature higher than 620° C., the problem that crystal grains coarsens occurs and there is a possibility of a decrease in the proof stress, the tensile strength, the elongation, and the bending fatigue resistance. Also, since elements other than aluminum are contained more than pure aluminum, the fusing point lowers and may melt partially. The solution heat treatment temperature described above is preferably in a range of 500° C. to 600° C., and more preferably in a range of 520° C. to 580° C.

A method of performing the first heat treatment may be, for example, batch heat treatment or may be continuous heat treatment such as high-frequency heating, conduction heating, and running heating, and it is advantageous to use continuous heat treatment in which heat treatment is performed by joule heat generated from a wire rod itself, such as high-frequency heating and conduction heating, because of a greater tendency that the crystal grain size at the outer peripheral portion is smaller than the crystal grain size at the inner portion.

In a case where high-frequency heating and conduction heating are used, a wire rod temperature increases with an elapse of time, since it normally has a structure in which electric current continues flowing through the wire rod. Accordingly, since the wire rod may melt when an electric current continues flowing through, it is necessary to perform heat treatment in an appropriate time range. In a case where running heating is used, since it is an annealing in a short time, the temperature of a running annealing furnace is usually set higher than the wire rod temperature. Since the wire rod may melt with a heat treatment over a long time, it is necessary to perform heat treatment in an appropriate time range. Also, all heat treatments require at least a predetermined time period in which Mg and Si compounds contained randomly in the work piece will be dissolved into an aluminum alloy. Hereinafter, the heat treatment by each method will be described.

The continuous heat treatment by high-frequency heating is a heat treatment by joule heat generated from the wire rod itself by an induced current by the wire rod continuously passing through a magnetic field caused by a high frequency. Steps of rapid heating and rapid cooling are included, and the wire rod can be heat-treated by controlling the wire rod temperature and the heat treatment time. The cooling is performed after rapid heating by continuously allowing the wire rod to pass through water or in a nitrogen gas atmosphere. This heat treatment time is 0.01 s to 2 s, preferably 0.05 s to 1 s, and more preferably 0.05 s to 0.5 s.

The continuous conducting heat treatment is a heat treatment by joule heat generated from the wire rod itself by allowing an electric current to flow in the wire rod that continuously passes two electrode wheels. Steps of rapid heating and rapid cooling are included, and the wire rod can be heat-treated by controlling the wire rod temperature and the heat treatment time. The cooling is performed after rapid heating by continuously allowing the wire rod to pass through water, atmosphere or a nitrogen gas atmosphere. This heat treatment time period is 0.01 s to 2 s, preferably 0.05 s to 1 s, and more preferably 0.05 s to 0.5 s.

A continuous running heat treatment is a heat treatment in which the wire rod continuously passes through a heat treatment furnace maintained at a high-temperature. Steps of rapid heating and rapid cooling are included, and the wire rod can be heat-treated by controlling the temperature in the heat treatment furnace and the heat treatment time. The cooling is performed after rapid heating by continuously allowing the wire rod to pass through water, atmosphere or a nitrogen gas atmosphere. This heat treatment time period is 0.5 s to 120 s, preferably 0.5 s to 60 s, and more preferably 0.5 s to 20 s.

The batch heat treatment is a method in which a wire rod is placed in an annealing furnace and heat-treated at a predetermined temperature setting and a setup time. The wire rod itself should be heated at a predetermined temperature for about several tens of seconds, but in industrial application, it is preferable to perform for more than 30 minutes to suppress uneven heat treatment on the wire rod. An upper limit of the heat treatment time is not particularly limited as long as coarsening of crystal grains does not occur, but in industrial application, since productivity increases when performed in a short time, heat treatment is performed within ten hours, and preferably within six hours.

The first strain processing, which is carried out before the solution heat treatment, during the solution heat treatment or both, causes a low strain in the outer peripheral portion of the work piece. Therefore, the outer peripheral portion comes to a state where it has been subjected to heavier processing and a crystal grain size at the outer peripheral portion becomes smaller after the solution treatment. The first strain processing is a process of threading the work piece through one or more pulleys, each having a diameter of 10 cm to 50 cm, to deform the work piece, where an amount of strain of the work piece is 0.0006 to 0.0150. The amount of strain is obtained by dividing a radius of the work piece by a sum of the radius of the pulley multiplied by two and the radius of the work piece.

[8] Stranding Process

A plurality of the wire rods which have been subjected to the solution heat treatment and the first strain processing are bundled and stranded. This step may be carried out before or after the solution heat treatment or may be carried out after the aging heat treatment. In this embodiment, the stranding process is performed, but the stranding step may be omitted, and the following aging heat treatment may be performed on a single wire rod subjected to the solution heat treatment and the first strain processing.

[9] Aging Heat Treatment (Second Heat Treatment) and Second Strain Processing

An aging heat treatment and the second strain processing are applied on the stranded wire of wire rods. The aging heat treatment is conducted for the purpose of causing precipitation of acicular $Mg_2Si$ precipitates. The heating temperature in the aging heat treatment is 140° C. to 250° C. When the heating temperature is lower than 140° C., it is not possible to cause precipitation of the acicular $Mg_2Si$ precipitates sufficiently, and strength, bending fatigue resistance and conductivity tend to lack. When the heating temperature is higher than 250° C., due to an increase in the size of the $Mg_2Si$ precipitate, the conductivity increases, but strength and bending fatigue resistance tend to lack. As for the heating time, the most suitable length of time varies with temperature. In order to improve a strength and a bending fatigue resistance, the heating time is preferably long when the temperature is low and the heating time is short when the temperature is high. Considering the productivity, a short period of time is preferable, which is preferably 15 hours or less and further preferably 10 hours or less.

The second strain processing that is performed before the aging heat treatment is a process that causes a low strain in the outer peripheral portion of the wire rod. Therefore, due to deformation such as a crush, the grain size of the outer peripheral portion becomes small. When a processing strain is excessively large, too much working is applied and leads to a decrease in elongation. The second strain processing is a process of threading the wire rod through one or more bobbins or spools, each having a diameter of 30 cm to 60 cm, to deform the wire rod, where an amount of strain of the wire rod is 0.0005 to 0.0050. The amount of strain is obtained by dividing the radius of the wire rod by a sum of a radius of the bobbin (spool) multiplied by two and the radius of the work piece. Note that a bobbin or a spool as used herein is a member that has a cylindrical outer edge and that allows winding up of the wire rod along an outer edge thereof.

(Aluminum Alloy Wire Rod 2*a*)

A strand diameter of the aluminum alloy wire rod 2*a* of the present embodiment is not particularly limited and can be determined as appropriate depending on an application, and it is preferably φ 0.1 mm to φ 0.5 mm for a fine wire, and φ 0.8 mm to φ 1.5 mm for a case of a middle sized wire. This aluminum alloy wire rod 2*a* can be represented as a wire rod including an outer peripheral portion formed in the aluminum alloy wire rod 2*a* and an inner portion that is a remaining portion other than the outer peripheral portion. The outer peripheral portion as used herein is a region of the aluminum alloy wire rod in the vicinity of an outer edge of the aluminum alloy wire rod and including the outer edge. In the case of the aluminum alloy wire rod having a circular shape in a cross section perpendicular to a wire drawing direction, the outer peripheral portion refers to a region including an outer edge of the aluminum alloy wire rod and having a width of 1/10 of a diameter of the aluminum alloy wire rod from the outer edge (see FIG. 2). In a case of the aluminum alloy wire rod having a cross section that is not circular, such as a compressed stranded wire, at first, a circle equivalent diameter is determined from the cross section of the aluminum alloy wire rod. In this case, the outer peripheral portion is a region including an outer edge of the aluminum alloy wire rod and having a width of 1/10 of a circle equivalent diameter of the aluminum alloy wire rod from the outer edge.

By making the average crystal grain size at the outer peripheral portion smaller, in other words, by making only the average crystal grain size at the outer peripheral portion smaller, a high conductivity, a high bending fatigue resistance, an appropriate proof stress and a high elongation property are achieved at the same time. Further, by making the average crystal grain size at the outer peripheral portion smaller than the average crystal grain size at the inner portion, e.g., by making the average crystal grain size at the outer peripheral portion a predetermined value within the aforementioned range and increasing the average crystal grain size at the inner portion, a proof stress can be appropriately decreased and also an elongation can be increased, with little a change in the conductivity and the number of cycles to fracture.

Specifically, it is desirable that the inner portion has an average crystal grain size that is 1.1 times or more of the average crystal grain size of the outer peripheral portion, and can thereby positively achieve the aforementioned effect.

The aluminum alloy wire rod 2*a* and the aluminum alloy stranded wire have been described above, but the aluminum alloy wire rod 2*a* as used herein and a method of manufacturing thereof are not limited to the embodiment described above, and various alterations and modifications are possible based on a technical idea of the present disclosure.

For example, although the range of the die half angle in the first wire drawing process is the same as the range of the die half angle in the second wire drawing process, the die half angle of the first wire drawing process may also be greater or smaller than the die half angle of the second wire drawing process. Also, although the range of the reduction ratio in the first wire drawing process is the same as the range of the reduction ratio in the second wire drawing process, the reduction ratio of the first wire drawing process may also be greater or smaller than the reduction ratio of the second wire drawing process.

Also, in the aforementioned embodiment, the first low strain process is performed in during the solution heat treatment, but it may also be performed before the solution heat treatment. Also, the second low strain processing is performed during the aging heat treatment, but the second low strain process does not need to be performed.

EXAMPLE

The aluminum alloy wire rod 2*a* of the electric wire with terminal 1 of the present embodiment will be described in further detail based on the following examples.

Example I

Using a Properzi-type continuous casting rolling mill, molten metal containing Mg, Si, Fe and Al, and selectively added Cu, Zr, Ti and B with contents (mass %) shown in Table 1 is cast with a water-cooled mold and rolled into a bar of approximately φ 9.5 mm. A casting cooling rate at this time was 1° C./s to 20° C./s. Then, a first wire drawing was carried out to obtain a reduction ratio shown in Table 2. Then, an intermediate heat treatment was performed on a work piece subjected to the first wire drawing, and thereafter, a second wire drawing was performed with a reduction ratio similar to the first wire drawing until a wire size of φ 0.3 mm. Then, a solution heat treatment (first heat treatment) was applied under conditions shown in Table 3. In the solution heat treatment, in a case of a batch heat treatment, a wire rod temperature was measured with a thermocouple wound around the wire rod. In a case of continuous conducting heat treatment, since measurement at a part where the temperature of the wire rod is the highest is difficult due to the facility, the temperature was measured with a fiber optic radiation thermometer (manufactured by Japan Sensor Corporation) at a position upstream of a portion where the temperature of the wire rod becomes highest, and a maximum temperature was calculated in consideration of joule heat and heat dissipation. In a case of high-frequency heating and consecutive running heat treatment, a wire rod temperature in the vicinity of a heat treatment section outlet was measured. After the solution heat treatment, an aging heat treatment (second heat treatment) was applied under conditions shown in Table 3 to produce an aluminum alloy wire.

Example II

Except that Mg, Si, Fe and Al and selectively added Cu, Mn, Cr, Zr, Au, Ag, Hf, V, Ni, Sc, Co, Ti and B were combined with contents (mass %) shown in Table 4, casting and rolling were carried out with a method similar to that of Example I to form a rod of approximately φ 9.5 mm. Then, the first wire drawing was performed to obtain a reduction ratio shown in Table 5. Then, an intermediate heat treatment was performed on a work piece subjected to the first wire drawing, and thereafter, a second wire drawing was performed with a reduction ratio similar to the first wire drawing until a wire size of φ 0.3 mm. Then, a solution heat treatment (first heat treatment) was applied under conditions shown in Table 6. After the solution heat treatment, an aging heat treatment (second heat treatment) was applied under conditions shown in Table 6 to produce an aluminum alloy wire.

For each of aluminum alloy wires of the Example and the Comparative Example, each characteristic was measured by methods shown below. The results are shown in Tables 3 and 6.

(a) Average Crystal Grain Size

A surface obtained by cutting in parallel with the wire drawing direction was filled with resin so as to be observable, and subjected to mechanical polishing followed by electropolishing. This structure was captured with an optical microscope of a magnification of 200 to 400, and a grain size measurement was carried out by an intercept method in conformity with JIS H0501 and H0502. In detail, a straight line parallel to the wire drawing direction was drawn in the captured image and the number of grain boundaries that intercept the straight line was counted. Such measurement was carried out for each of the outer peripheral portion and the inner portion of the aluminum alloy wire rod 2*a*, such that the straight line cuts across (or is tangent to) about fifty grain boundaries, and the average crystal grain size was calculated by an equation below:

$$D=L1/(n1+2\times n2),$$

where n1 is the number of times grain boundaries and the straight line intercept;

n2 is the number of tangential points; and

L1 is a length of the straight line.

In the above equation, the number of tangential points n2 between the grain boundary and the straight line was multiplied by two and summed. It is preferable that the length of the aforementioned straight line is as great as possible. Accordingly, measurement was carried out while adjusting the length and the number of the straight lines, such that, considering the ease of operation, the crystal grain size of about fifty crystal grains can be measured, and a plurality of straight lines are used to avoid a long straight line extending beyond an imaging range of the optical microscope.

Figure 3A:
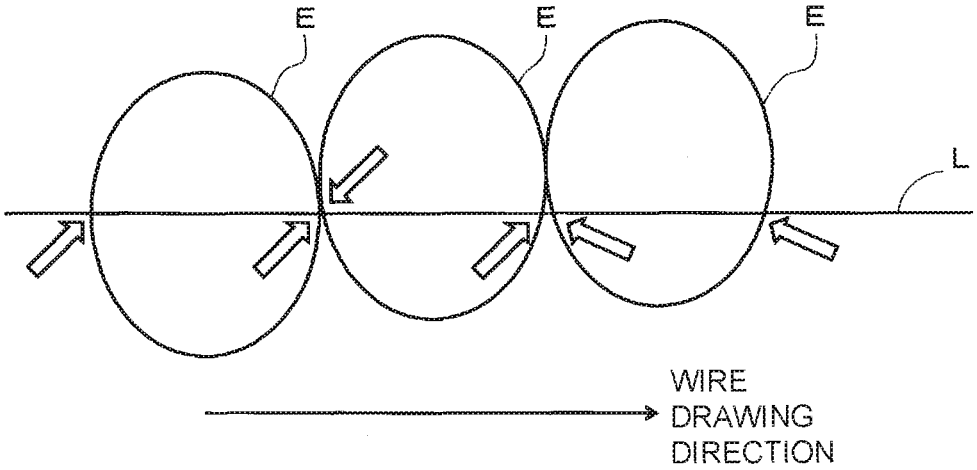
FIGS. 3A and 3B are diagrams for explaining a calculation method of a crystal grain size in Examples.
Figure 3B:
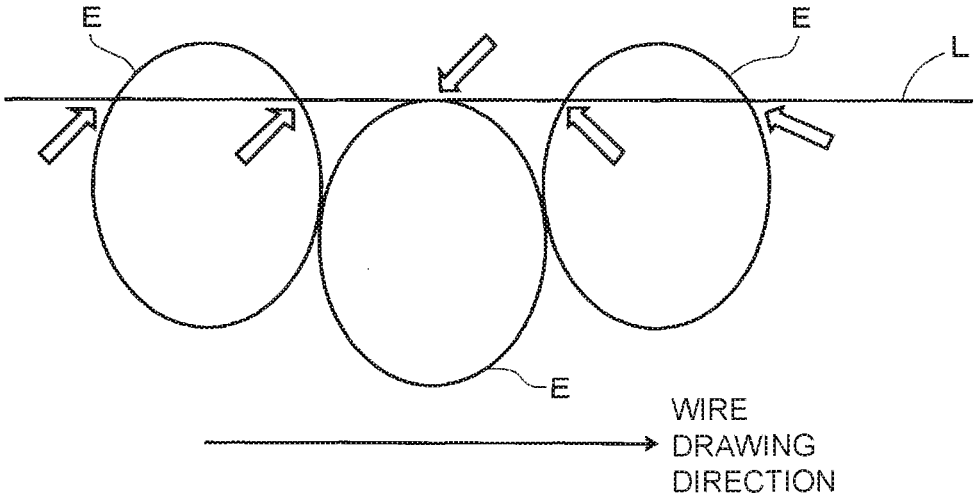

FIGS. 3A and 3B are diagrams showing how a grain size is calculated in Examples. FIG. 3A shows a case in which a straight line L parallel to the wire drawing direction intercepts grain boundaries, and FIG. 3B shows a case in which the straight line L is tangent to a grain boundary. In FIGS. 3A and 3B, an ellipse E represent a grain boundary, and a white arrow indicates a tangent point or a point of intersection between an ellipses E and the straight line L. The measurement was conducted three times at a 1-meter interval, and crystal grain sizes were obtained using the aforementioned equation. An average crystal grain size was obtained by averaging the crystal grain sizes. An average crystal grain size at an inner portion of the aluminum alloy wire rod was calculated using an intersection method in an area of a half the diameter of the wire rod from the center of the wire rod, and an average crystal grain size of the outer peripheral portion was calculated using an intersection method in an area of 9/10 to 10/10 of the diameter of the wire rod from the center of the wire rod. The outer peripheral portion of the aluminum alloy wire rod was measured at a measurement position that is at a midpoint in a radial direction of the outer peripheral portion in a radial-direction cross-section of the wire rod, and the inner portion of the aluminum alloy wire rod was measured at a measurement position that is at midpoint between the center of the radial-direction cross-section of the wire rod and the boundary of the inner portion and the outer peripheral portion.

(b) Number of Cycles to Fracture

As a reference of the bending fatigue resistance, a strain amplitude at an ordinary temperature is assumed as ±0.17% at a surface of the wire rod. The bending fatigue resistance varies depending on the strain amplitude. In a case where the strain amplitude is large, a fatigue life decreases, and in a case where the strain amplitude is small, the fatigue life increases. Since the strain amplitude can be determined by a wire size of the wire rod and a radius of curvature of a bending jig, a bending fatigue test can be carried out by setting the wire size of the wire rod and the radius of curvature of the bending jig as required. With a reversed bending fatigue tester manufactured by Fujii Seiki Co., Ltd. (existing company Fujii Co., Ltd.) and using a jig that can give a 0.17% bending strain, a repeated bending was carried out and a number of cycles to fracture was measured. In the present examples, number of cycles to fracture of 100,000 times or more was regarded as acceptable.

(c) Measurement of Proof Stress (0.2% Proof Stress) and Flexibility (Elongation after Fracture)

In conformity with JIS Z2241, a tensile test was carried out for three materials under test (aluminum alloy wires) each time and a 0.2% proof stress was calculated using a prescribed permanent elongation of 0.2% by an offset method, and an average value thereof was obtained. The proof stress of greater than or equal to 50 MPa and less than or equal to 320 MPa was regarded as acceptable so as to withstand a load abruptly applied during an installation work to a car body and to avoid a decrease in a working efficiency during installation of the wire harness. As for the elongation, an elongation after fracture of greater than or equal to 5% was regarded as acceptable.

(d) Conductivity (EC)

In a constant temperature bath in which a test piece of 300 mm in length is held at 20° C. (±0.5° C.), a resistivity was measured for three materials under test (aluminum alloy wires) each time using a four terminal method, and an average conductivity was calculated. The distance between the terminals was 200 mm. The conductivity is not particularly prescribed, but those greater than or equal to 35% were regarded as acceptable. Note that the conductivity of greater than or equal to 45% IACS is preferable, and 45% to 55% IACS is particularly preferable.

TABLE 1

| | | COMPOSITION mass % | | | | | | | | | | | | | | | | |
|---|---|---|---|---|---|---|---|---|---|---|---|---|---|---|---|---|---|---|
| | No. | Mg | Si | Fe | Cu | Mn | Hf | V | Sc | Co | Ni | Cr | Zr | Au | Ag | Ti | B | Al |
| EXAMPLE | 1 | 0.60 | 0.60 | 0.20 | 0.20 | | | | | | | | 0.10 | | | 0.010 | 0.005 | BALANCE |
| | 2 | 0.60 | 0.60 | 0.20 | 0.20 | | | | | | | | 0.10 | | | 0.010 | 0.005 | |
| | 3 | 0.60 | 0.60 | 0.20 | 0.20 | | | | | | | | 0.10 | | | 0.010 | 0.005 | |
| | 4 | 0.60 | 0.60 | 0.20 | 0.20 | | | | | | | | 0.10 | | | 0.010 | 0.005 | |

TABLE 1-continued

| | No. | COMPOSITION mass % | | | | | | | | | | | | | | | | |
|---|---|---|---|---|---|---|---|---|---|---|---|---|---|---|---|---|---|---|
| | | Mg | Si | Fe | Cu | Mn | Hf | V | Sc | Co | Ni | Cr | Zr | Au | Ag | Ti | B | Al |
| | 5 | 0.60 | 0.60 | 0.20 | 0.20 | | | | | | | | 0.10 | | | 0.010 | 0.005 | |
| | 6 | 0.60 | 0.60 | 0.20 | 0.20 | | | | | | | | 0.10 | | | 0.010 | 0.005 | |
| | 7 | 0.60 | 0.60 | 0.20 | 0.20 | | | | | | | | 0.10 | | | 0.010 | 0.005 | |
| | 8 | 0.60 | 0.60 | 0.20 | 0.20 | | | | | | | | 0.10 | | | 0.010 | 0.005 | |
| | 9 | 0.60 | 0.60 | 0.20 | 0.20 | | | | | | | | 0.10 | | | 0.010 | 0.005 | |
| | 10 | 0.60 | 0.60 | 0.20 | 0.20 | | | | | | | | 0.10 | | | 0.010 | 0.005 | |
| | 11 | 0.60 | 0.60 | 0.20 | 0.20 | | | | | | | | 0.10 | | | 0.010 | 0.005 | |
| | 12 | 0.60 | 0.60 | 0.20 | 0.20 | | | | | | | | 0.10 | | | 0.010 | 0.005 | |
| | 13 | 0.60 | 0.60 | 0.20 | 0.20 | | | | | | | | 0.10 | | | 0.010 | 0.005 | |
| | 14 | 0.60 | 0.60 | 0.20 | 0.20 | | | | | | | | 0.10 | | | 0.010 | 0.005 | |
| | 15 | 0.60 | 0.60 | 0.20 | 0.20 | | | | | | | | 0.10 | | | 0.010 | 0.005 | |
| | 16 | 0.60 | 0.60 | 0.20 | 0.20 | | | | | | | | 0.10 | | | 0.010 | 0.005 | |
| | 17 | 0.60 | 0.60 | 0.20 | 0.20 | | | | | | | | 0.10 | | | 0.010 | 0.005 | |
| | 18 | 0.60 | 0.60 | 0.20 | 0.20 | | | | | | | | 0.10 | | | 0.010 | 0.005 | |
| | 19 | 0.60 | 0.60 | 0.20 | 0.20 | | | | | | | | 0.10 | | | 0.010 | 0.005 | |
| | 20 | 0.60 | 0.60 | 0.20 | 0.20 | | | | | | | | 0.10 | | | 0.010 | 0.005 | |
| | 21 | 0.60 | 0.60 | 0.20 | 0.20 | | | | | | | | 0.10 | | | 0.010 | 0.005 | |
| | 22 | 0.60 | 0.60 | 0.20 | 0.20 | | | | | | | | 0.10 | | | 0.010 | 0.005 | |
| | 23 | 0.60 | 0.60 | 0.20 | 0.20 | | | | | | | | 0.10 | | | 0.010 | 0.005 | |
| | 24 | 0.60 | 0.60 | 0.20 | 0.20 | | | | | | | | 0.10 | | | 0.010 | 0.005 | |
| | 25 | 0.60 | 0.60 | 0.20 | 0.20 | | | | | | | | 0.10 | | | 0.010 | 0.005 | |
| | 26 | 0.60 | 0.60 | 0.20 | 0.20 | | | | | | | | 0.10 | | | 0.010 | 0.005 | |
| | 27 | 0.60 | 0.60 | 0.20 | 0.20 | | | | | | | | 0.10 | | | 0.010 | 0.005 | |
| | 28 | 0.60 | 0.60 | 0.20 | 0.20 | | | | | | | | 0.10 | | | 0.010 | 0.005 | |
| | 29 | 0.60 | 0.60 | 0.20 | 0.20 | | | | | | | | 0.10 | | | 0.010 | 0.005 | |
| | 30 | 0.60 | 0.60 | 0.20 | 0.20 | | | | | | | | 0.10 | | | 0.010 | 0.005 | |
| | 31 | 0.60 | 0.60 | 0.20 | 0.20 | | | | | | | | 0.10 | | | 0.010 | 0.005 | |
| COMPARATIVE EXAMPLE | 1 | 0.60 | 0.60 | 0.20 | 0.20 | | | | | | | | 0.10 | | | 0.010 | 0.005 | |
| | 2 | 0.60 | 0.60 | 0.20 | 0.20 | | | | | | | | 0.10 | | | 0.010 | 0.005 | |
| | 3 | 0.60 | 0.60 | 0.20 | 0.20 | | | | | | | | 0.10 | | | 0.010 | 0.005 | |
| | 4 | 0.60 | 0.60 | 0.20 | 0.20 | | | | | | | | 0.10 | | | 0.010 | 0.005 | |

TABLE 2

| | No. | 1st and 2nd Wire Drawing Process Reduction Ratio Per Pass % | 1st and 2nd Wire Drawing Process Die Half Angle DEGREE | Low Strain Before 1st Heat Treatment | Low Strain During 1st Heat Treatment | Low Strain Before 2nd Heat Treatment |
|---|---|---|---|---|---|---|
| EXAMPLE | 1 | 10 | 10 | YES | YES | NO |
| | 2 | 7 | 17 | NO | NO | NO |
| | 3 | 4 | 25 | NO | NO | NO |
| | 4 | 1 | 30 | NO | NO | NO |
| | 5 | 10 | 10 | YES | NO | NO |
| | 6 | 7 | 16 | NO | NO | NO |
| | 7 | 10 | 30 | YES | YES | NO |
| | 8 | 7 | 25 | NO | NO | NO |
| | 9 | 4 | 17 | NO | NO | NO |
| | 10 | 1 | 10 | YES | YES | NO |
| | 11 | 4 | 24 | NO | NO | YES |
| | 12 | 1 | 30 | NO | NO | NO |
| | 13 | 10 | 10 | YES | NO | YES |
| | 14 | 7 | 17 | NO | YES | YES |
| | 15 | 4 | 25 | YES | NO | YES |
| | 16 | 1 | 30 | YES | YES | YES |
| | 17 | 10 | 10 | YES | YES | NO |
| | 18 | 7 | 17 | NO | NO | NO |
| | 19 | 4 | 25 | NO | NO | NO |
| | 20 | 1 | 30 | NO | NO | NO |
| | 21 | 10 | 10 | NO | NO | NO |
| | 22 | 7 | 17 | NO | NO | NO |
| | 23 | 4 | 25 | NO | NO | NO |
| | 24 | 1 | 30 | YES | YES | NO |
| | 25 | 10 | 30 | NO | NO | NO |
| | 26 | 7 | 17 | NO | NO | NO |
| | 27 | 4 | 10 | NO | NO | NO |
| | 28 | 1 | 25 | NO | NO | NO |
| | 29 | 10 | 10 | NO | NO | NO |
| | 30 | 7 | 17 | YES | YES | YES |
| | 31 | 4 | 25 | NO | NO | NO |

TABLE 2-continued

| | No. | 1st and 2nd Wire Drawing Process Reduction Ratio Per Pass % | 1st and 2nd Wire Drawing Process Die Half Angle DEGREE | Low Strain Before 1st Heat Treatment | Low Strain During 1st Heat Treatment | Low Strain Before 2nd Heat Treatment |
|---|---|---|---|---|---|---|
| COMPARATIVE EXAMPLE | 1 | ***22*** | 10 | NO | NO | NO |
| | 2 | 10 | ***6*** | NO | NO | NO |
| | 3 | ***24*** | ***5*** | NO | NO | NO |
| | 4 | 10 | ***40*** | NO | NO | NO |

N.B. NUMERICAL VALUES IN BOLD ITALIC IN THE TABLE ARE OUT OF APPROPRIATE RANGE OF THE EXAMPLE

TABLE 3

| | | 1st Heat Treatment Condition | | | 2nd Heat Treatment Condition | | Ave. Crystal Grain Size at Outer | Ave. Crystal Grain Size at | Number of | | | |
|---|---|---|---|---|---|---|---|---|---|---|---|---|
| | No. | Method | Heating Temp. ° C. | Heating Time | Heating Temp. ° C. | Heating Time h | Peripheral Portion μm | Inner Portion μm | Cycles to Fracture ($10^4$ Cycles) | Proof Stress MPa | Elongation % | Conductivity (% IACS) |
| EXAMPLE | 1 | Batch | 580 | 10 min | 175 | 5 | 34 | 45 | 20 | 70 | 7 | 47 |
| | 2 | High-Freq. | 520 | 0.06 sec | 175 | 1 | 2 | 3 | 75 | 200 | 15 | 47 |
| | 3 | High-Freq. | 480 | 0.06 sec | 175 | 15 | 1 | 2 | 129 | 314 | 12 | 50 |
| | 4 | High-Freq. | 550 | 0.17 sec | 200 | 5 | 9 | 13 | 40 | 107 | 7 | 52 |
| | 5 | Conduction | 550 | 0.13 sec | 200 | 10 | 8 | 10 | 55 | 180 | 8 | 52 |
| | 6 | Conduction | 520 | 0.1 sec | 175 | 5 | 5 | 6 | 50 | 145 | 14 | 47 |
| | 7 | High-Freq. | 620 | 0.5 sec | 140 | 1 | 14 | 21 | 27 | 92 | 15 | 47 |
| | 8 | Running | 580 | 10 sec | 250 | 5 | 21 | 25 | 37 | 105 | 6 | 53 |
| | 9 | High-Freq. | 500 | 1 sec | 225 | 10 | 6 | 7 | 42 | 121 | 6 | 55 |
| | 10 | Running | 550 | 5 sec | 140 | 15 | 15 | 19 | 48 | 196 | 12 | 49 |
| | 11 | Batch | 580 | 60 min | 175 | 15 | 34 | 49 | 80 | 265 | 5 | 49 |
| | 12 | Conduction | 620 | 0.2 sec | 200 | 1 | 14 | 20 | 29 | 81 | 7 | 50 |
| | 13 | Batch | 580 | 60 min | 175 | 15 | 35 | 49 | 76 | 260 | 5 | 50 |
| | 14 | Batch | 480 | 60 min | 150 | 15 | 19 | 27 | 48 | 199 | 11 | 47 |
| | 15 | Batch | 580 | 60 min | 150 | 5 | 31 | 49 | 23 | 73 | 9 | 46 |
| | 16 | Conduction | 580 | 0.13 sec | 200 | 5 | 6 | 11 | 35 | 110 | 8 | 52 |
| | 17 | Batch | 580 | 30 min | 200 | 15 | 35 | 46 | 10 | 50 | 5 | 53 |
| | 18 | Batch | 520 | 10 min | 175 | 5 | 24 | 29 | 40 | 140 | 11 | 49 |
| | 19 | Batch | 550 | 60 min | 150 | 15 | 32 | 42 | 70 | 230 | 8 | 48 |
| | 20 | High-Freq. | 580 | 0.1 sec | 175 | 5 | 6 | 8 | 47 | 150 | 14 | 49 |
| | 21 | Running | 620 | 1 sec | 150 | 1 | 22 | 24 | 26 | 88 | 16 | 48 |
| | 22 | High-Freq. | 520 | 0.06 sec | 175 | 15 | 1 | 2 | 130 | 320 | 9 | 50 |
| | 23 | Batch | 550 | 30 min | 175 | 10 | 25 | 32 | 61 | 210 | 14 | 50 |
| | 24 | Batch | 580 | 60 min | 200 | 10 | 29 | 49 | 51 | 175 | 5 | 52 |
| | 25 | Conduction | 580 | 0.13 sec | 200 | 5 | 10 | 13 | 39 | 105 | 8 | 52 |
| | 26 | High-Freq. | 480 | 0.2 sec | 150 | 10 | 1 | 2 | 128 | 305 | 16 | 48 |
| | 27 | Conduction | 580 | 1 sec | 200 | 5 | 17 | 20 | 37 | 91 | 15 | 53 |
| | 28 | Conduction | 580 | 0.5 sec | 200 | 5 | 11 | 15 | 41 | 110 | 7 | 53 |
| | 29 | High-Freq. | 550 | 0.13 sec | 150 | 15 | 7 | 8 | 77 | 249 | 13 | 48 |
| | 30 | Batch | 620 | 60 min | 175 | 1 | 34 | 54 | 11 | 52 | 8 | 48 |
| | 31 | Batch | 550 | 30 min | 200 | 5 | 27 | 35 | 55 | 100 | 5 | 52 |
| COMPARATIVE EXAMPLE | 1 | Batch | 580 | 30 min | 150 | 10 | ***37*** | 36 | ***7*** | 99 | 10 | 47 |
| | 2 | Batch | 580 | 50 min | 150 | 5 | ***39*** | 39 | ***5*** | 98 | 10 | 46 |
| | 3 | Batch | 600 | 30 min | 150 | 10 | ***41*** | 40 | ***4*** | 97 | 9 | 47 |
| | 4 | Batch | 640 | 60 min | 150 | 5 | ***85*** | 47 | ***1*** | ***45*** | 4 | 46 |

N.B. NUMERICAL VALUES IN BOLD ITALIC IN THE TABLE ARE OUT OF APPROPRIATE RANGE OF THE EXAMPLE

TABLE 4

| | | COMPOSITION MASS % | | | | | | | | | | | | | | | | |
|---|---|---|---|---|---|---|---|---|---|---|---|---|---|---|---|---|---|---|
| | No. | Mg | Si | Fe | Cu | Mn | Hf | V | Sc | Co | Ni | Cr | Zr | Au | Ag | Ti | B | Al |
| EXAMPLE | 32 | 0.20 | 0.20 | 0.01 | 0.20 | 0.20 | | | | | | | 0.10 | | | 0.010 | 0.005 | BALANCE |
| | 33 | 0.30 | 0.30 | 0.10 | 0.10 | | | | | | | | | 0.50 | 0.50 | 0.010 | 0.005 | |
| | 34 | 0.40 | 0.40 | 0.20 | 0.30 | | | | | | | 0.30 | | | | | | |
| | 35 | 0.70 | 0.70 | 0.20 | | 0.05 | | | | | | | | | | 0.010 | 0.005 | |
| | 36 | 0.32 | 0.40 | 0.20 | | | | | | | | | | | | | | |
| | 37 | 0.80 | 0.80 | 0.30 | | | | | | | | | 0.20 | | | 0.010 | 0.005 | |
| | 38 | 0.60 | 0.60 | 0.01 | 0.50 | | | | | | | | | | | 0.010 | 0.005 | |
| | 39 | 0.10 | 0.80 | 0.20 | | | | | | | | 0.10 | | | | | | |

TABLE 4-continued

| | No. | COMPOSITION MASS % Mg | Si | Fe | Cu | Mn | Hf | V | Sc | Co | Ni | Cr | Zr | Au | Ag | Ti | B | Al |
|---|---|---|---|---|---|---|---|---|---|---|---|---|---|---|---|---|---|---|
| | 40 | 0.30 | 0.60 | 0.10 | 0.20 | 0.30 | | | | | | | | | | 0.010 | 0.005 | |
| | 41 | 0.40 | 0.50 | 0.20 | 0.20 | | | | | | | | 0.30 | | | 0.010 | 0.005 | |
| | 42 | 0.55 | 0.55 | 0.20 | | | | | | | | | | | | | | |
| | 43 | 0.40 | 0.50 | 0.20 | | | | | | 0.05 | | | | | | 0.010 | 0.005 | |
| | 44 | 0.50 | 0.40 | 0.40 | | | | | | | | | | | | | | |
| | 45 | 0.70 | 0.30 | 0.25 | 0.10 | | | | | 0.20 | | | | | 0.10 | | | |
| | 46 | 0.80 | 0.10 | 0.20 | | 0.10 | | | | | | | 0.20 | | | 0.010 | 0.005 | |
| | 47 | 0.30 | 0.30 | 0.20 | | 0.50 | | | | | | | | | | | | |
| | 48 | 0.40 | 0.40 | 0.20 | | | 0.01 | 0.50 | | | | 0.50 | | | | | | |
| | 49 | 0.64 | 0.52 | 0.20 | | | | | | | | | 0.01 | | | | | |
| | 50 | 0.40 | 0.40 | 0.10 | | | | | 0.01 | | 0.50 | | | | | 0.020 | 0.010 | |
| | 51 | 0.50 | 0.50 | 0.10 | | | 0.50 | | | | | | | | | 0.020 | 0.010 | |
| | 52 | 0.60 | 0.60 | 0.10 | | | | | 0.50 | | | | | | | 0.020 | 0.010 | |
| | 53 | 0.60 | 0.60 | 0.10 | | | | 0.01 | | | 0.01 | | | | | 0.020 | 0.010 | |
| COMPAR- | 5 | ***0.01*** | 0.01 | 0.20 | 0.005 | 0.005 | | | | | | | | | | 0.010 | 0.005 | |
| ATIVE | 6 | 0.51 | 0.41 | 0.15 | | | | | | | | | 0.07 | | | 0.010 | 0.002 | |
| EXAM- | 7 | ***2.00*** | ***3.00*** | 0.20 | | | | | | | | | | | | 0.010 | 0.005 | |
| PLE | 8 | 0.55 | 0.55 | 0.20 | | | | | | | ***1.5*** | | | | | 0.010 | 0.005 | |
| | 9 | 0.55 | 0.55 | 0.20 | | ***1.5*** | | | | | | | | | | 0.010 | 0.005 | |
| | 10 | 0.55 | 0.55 | 0.20 | | | | | | | | | ***1.5*** | | | 0.010 | 0.005 | |
| | 11 | ***1.50*** | 0.60 | 0.20 | | | | | | | | ***1.2*** | | | | 0.010 | 0.005 | |
| | 12 | 0.67 | 0.52 | 0.40 | 0.20 | 0.20 | | | | | | | | | | 0.020 | 0.004 | |

N.B. NUMERICAL VALUES IN BOLD ITALIC IN THE TABLE ARE OUT OF APPROPRIATE RANGE OF THE EXAMPLE

TABLE 5

| | No. | 1st and 2nd Wire Drawing Process Reduction Ratio Per Pass % | 1st and 2nd Wire Drawing Process Die Half Angle Degree | Low Strain Process Before 1st Heat Treatment | Low Strain Process During 1st Heat Treatment | Low Strain Process Before 2nd Heat Treatment |
|---|---|---|---|---|---|---|
| EXAMPLE | 32 | 1 | 30 | YES | YES | YES |
| | 33 | 1 | 30 | YES | YES | YES |
| | 34 | 1 | 30 | YES | YES | YES |
| | 35 | 1 | 30 | YES | YES | YES |
| | 36 | 1 | 30 | YES | YES | YES |
| | 37 | 1 | 30 | YES | YES | YES |
| | 38 | 1 | 30 | YES | YES | YES |
| | 39 | 1 | 30 | YES | YES | YES |
| | 40 | 1 | 25 | YES | NO | YES |
| | 41 | 4 | 25 | YES | NO | YES |
| | 42 | 4 | 25 | YES | NO | YES |
| | 43 | 4 | 25 | YES | NO | YES |
| | 44 | 4 | 25 | YES | NO | YES |
| | 45 | 4 | 25 | YES | NO | YES |
| | 46 | 4 | 25 | YES | NO | YES |
| | 47 | 4 | 25 | YES | NO | YES |
| | 48 | 4 | 25 | YES | NO | YES |
| | 49 | 1 | 30 | YES | YES | NO |
| | 50 | 1 | 30 | YES | YES | NO |
| | 51 | 1 | 30 | YES | YES | NO |
| | 52 | 1 | 30 | YES | YES | NO |
| | 53 | 1 | 30 | YES | YES | NO |
| COMPARATIVE | 5 | ***25*** | ***5*** | NO | NO | NO |
| EXAMPLE | 6 | ***30*** | ***3*** | NO | NO | NO |
| | 7 | 10 | 10 | NO | NO | NO |
| | 8 | 10 | 10 | NO | NO | NO |
| | 9 | 10 | 10 | NO | NO | NO |
| | 10 | 10 | 10 | NO | NO | NO |
| | 11 | ***20*** | ***40*** | WIRE BREAK DURING DRAWING | | |
| | 12 | ***20*** | ***5*** | NO | NO | NO |

N.B. NUMERICAL VALUES IN BOLD ITALIC IN THE TABLE ARE OUT OF APPROPRIATE RANGE OF THE EXAMPLE

TABLE 6

| | No. | 1ST Heat Treatment Condition Method | Heating Temp. ° C. | Heating Time | 2nd Heat Treatment Condition Heating Temp. ° C. | Heating Time h | Average Crystal Grain Size at Outer Peripheral Portion μm | Average Crystal Grain Size at Inner Portion μm | Number of Cycles to Fracture $10^4$ Cycles | Proof Stress MPa | Elongation % | Conductivity % IACS |
|---|---|---|---|---|---|---|---|---|---|---|---|---|
| EXAMPLE | 32 | Conduction | 580 | 0.13 sec | 200 | 5 | 6 | 11 | 52 | 101 | 14 | 54 |
| | 33 | Conduction | 580 | 0.13 sec | 200 | 5 | 5 | 10 | 64 | 132 | 12 | 50 |
| | 34 | Conduction | 580 | 0.13 sec | 200 | 5 | 6 | 11 | 79 | 171 | 9 | 45 |
| | 35 | Conduction | 580 | 0.13 sec | 200 | 5 | 7 | 13 | 109 | 248 | 5 | 54 |
| | 36 | Conduction | 580 | 0.13 sec | 200 | 5 | 7 | 13 | 61 | 125 | 9 | 52 |
| | 37 | Conduction | 580 | 0.13 sec | 200 | 5 | 6 | 12 | 121 | 280 | 5 | 45 |
| | 38 | Conduction | 580 | 0.13 sec | 200 | 5 | 5 | 11 | 93 | 220 | 6 | 46 |
| | 39 | Conduction | 580 | 0.13 sec | 200 | 5 | 6 | 11 | 53 | 103 | 14 | 45 |
| | 40 | Batch | 580 | 60 min | 150 | 5 | 31 | 48 | 30 | 102 | 12 | 41 |
| | 41 | Batch | 580 | 60 min | 150 | 5 | 31 | 49 | 34 | 115 | 13 | 45 |
| | 42 | Batch | 580 | 60 min | 150 | 5 | 33 | 51 | 45 | 146 | 13 | 50 |
| | 43 | Batch | 580 | 60 min | 150 | 5 | 32 | 50 | 38 | 136 | 14 | 51 |
| | 44 | Batch | 580 | 60 min | 150 | 5 | 33 | 50 | 40 | 134 | 15 | 50 |
| | 45 | Batch | 580 | 60 min | 150 | 5 | 31 | 49 | 36 | 120 | 11 | 50 |
| | 46 | Batch | 580 | 60 min | 150 | 5 | 31 | 49 | 18 | 69 | 14 | 47 |
| | 47 | Batch | 580 | 60 min | 150 | 5 | 31 | 48 | 26 | 93 | 16 | 40 |
| | 48 | Batch | 580 | 60 min | 150 | 5 | 30 | 47 | 38 | 123 | 15 | 36 |
| | 49 | Batch | 580 | 60 min | 200 | 10 | 31 | 51 | 53 | 155 | 7 | 55 |
| | 50 | Batch | 580 | 60 min | 200 | 10 | 29 | 50 | 50 | 147 | 9 | 50 |
| | 51 | Batch | 580 | 60 min | 200 | 10 | 30 | 49 | 63 | 181 | 8 | 49 |
| | 52 | Batch | 580 | 60 min | 200 | 10 | 28 | 49 | 72 | 205 | 7 | 46 |
| | 53 | Batch | 580 | 60 min | 200 | 10 | 31 | 50 | 73 | 206 | 7 | 51 |
| COMPARATIVE EXAMPLE | 5 | Conduction | 580 | 0.13 sec | 175 | 10 | 25 | 25 | ***6*** | 75 | 13 | 63 |
| | 6 | High-Freq | 600 | 0.50 sec | 160 | 12 | ***40*** | 40 | ***9*** | 95 | 6 | 51 |
| | 7 | Conduction | 580 | 0.13 sec | 180 | 15 | 12 | 13 | ***5*** | ***370*** | ***0*** | 36 |
| | 8 | High-Freq | 550 | 0.13 sec | 150 | 15 | 7 | 8 | ***8*** | ***350*** | ***0*** | 37 |
| | 9 | Conduction | 580 | 0.13 sec | 180 | 15 | 12 | 13 | ***1*** | ***330*** | 1 | 33 |
| | 10 | High-Freq | 580 | 0.13 sec | 150 | 15 | 7 | 8 | ***3*** | ***350*** | ***0*** | 35 |
| | 11 | | | | | | | | | | | |
| | 12 | Batch | 580 | 3 h | 160 | 8 | ***45*** | 45 | ***8*** | ***330*** | 3.0 | 50 |

N.B. NUMERICAL VALUES IN BOLD ITALIC IN THE TABLE ARE OUT OF APPROPRIATE RANGE OF THE EXAMPLE

The following is elucidated from the results indicated in Table 3.

Each of aluminum alloy wires of Examples 1 to 31 was capable of achieving a high conductive property, a high bending fatigue resistance, an appropriate proof stress and a high elongation property simultaneously.

In contrast, in Comparative Example 1, a reduction ratio per pass and an average crystal grain size at the outer peripheral portion were beyond the scope of the present disclosure, and under this condition, the number of cycles to fracture was insufficient. In Comparative Example 2, a die half angle and an average crystal grain size at the outer peripheral portion were beyond the scope of the present disclosure, and the number of cycles to fracture was insufficient. In Comparative Example 3, a reduction ratio per pass, a die half angle and an average crystal grain size at the outer peripheral portion were beyond the scope of the present disclosure and the number of cycles to fracture was insufficient. In Comparative Example 4, a die half angle and an average crystal grain size at the outer periphery were beyond the scope of the present disclosure, and a number of cycles to fracture and a proof stress were insufficient.

Also, the following is elucidated from the results indicated in Table 6.

Each of aluminum alloy wires of Examples 32 to 53 was capable of achieving a high conductive property, a high bending fatigue resistance, an appropriate proof stress and a high elongation simultaneously.

In contrast, in Comparative Example 5 (pure aluminum), an Mg content, an Si content, a reduction ratio per pass and a die half angle were beyond the scope of the present disclosure and under this condition, the number of cycles to fracture was insufficient. In Comparative Example 6, a reduction ratio per pass, a die half angle and an average crystal grain size at the outer peripheral portion were beyond the scope of the present disclosure and the number of cycles to fracture was insufficient. In Comparative Example 7, an Mg—Si content was beyond the scope of the present disclosure, and, the number of cycles to fracture and an elongation were insufficient, and a proof stress was excessive.

In Comparative Example 8, an Ni-content was beyond the scope of the present disclosure, and the number of cycles to fracture and an elongation were insufficient and a proof stress was excessive. In Comparative Example 9, an Mn-content was beyond the scope of the present disclosure, and the number of cycles to fracture and a conductivity were insufficient and a proof stress was excessive. In Comparative Example 10, a Zr-content was beyond the scope of the present disclosure, and the number of cycles to fracture and an elongation were insufficient and a proof stress was excessive.

In Comparative Example 11, an Mg content and a Cr content were beyond the scope of the present disclosure, and under this condition, a wire break occurred during wire drawing. In Comparative Example 12, a reduction ratio per pass, a die half angle and an average crystal grain size at the outer peripheral portion were beyond the scope of the present disclosure, and, the number of cycles to fracture and a proof stress were excessive. Note that Comparative Example 12 corresponds to sample No. 18 in Japanese Patent No. 5155464.

(Evaluation of Characteristics of an Electric Wire with Terminal)

Seven aluminum alloy wire rods 2*a* manufactured by a method similar to that of Example 50 were stranded into an electric wire of 0.75 $mm^2$. Note that a resin composed primarily of polyvinyl chloride (PVC) was used as a resin coating layer. The resin coating layer was removed from the electric wire such that the aluminum alloy wire rod 2*a* was exposed by a length of 5 mm. The terminal was manufactured using a plate material comprising a copper alloy (FAS680).

Then, with a predetermined space remaining at a tip portion inside the thus-manufactured barrel portion, an exposed portion of the aluminum alloy wire rod 2*a* of the electric wire and a part of the resin coated portion were inserted, and the respective portions were crimped and the electric wire with terminal was manufactured. At this time, an end portion of the aluminum alloy wire rod 2*a* extends in the barrel portion 3*b* shown in FIG. 2, but, in the case of the present embodiment, repulses in a plane perpendicular to the longitudinal direction, and thus an elongation in the longitudinal direction was reduced.

Subsequently, the terminal and the crimp portion of the barrel portion in the electric wire with terminal were cut in a direction perpendicular to the longitudinal direction (a transverse cross section along line A-A of FIG. 1A). In the obtained cross section, a fill factor of a portion where the aluminum alloy wire rods 2*a* in the barrel portion 3*b* are stranded at a part where the barrel portion 3*b* is crimped to, in other words, an area factor of the conductor to an overall stranded cross section, was measured, and it was approximately 100%.

The aforementioned electric wire with terminal 1 was subjected to an air leak test at 50 kPa with an N-number of 10 times. The air leak testing conditions here are as follows.

Figure 2:
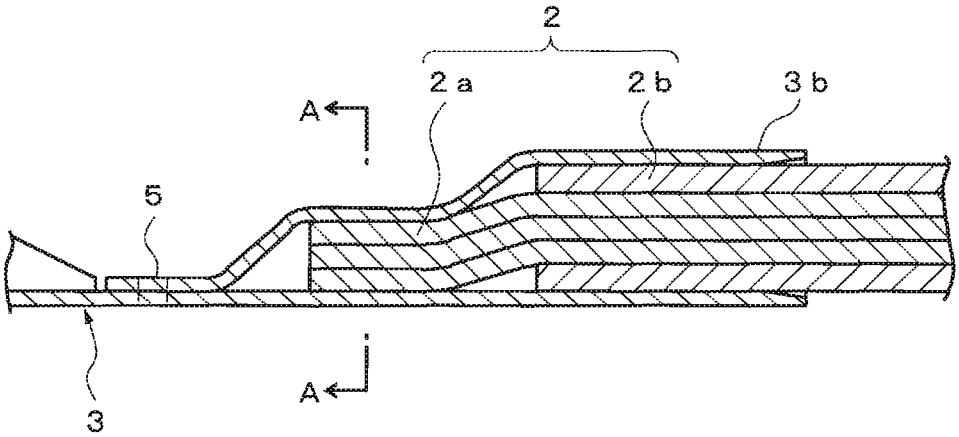
FIG. 2 is a partial longitudinal cross-sectional view taken along line B-B in FIG. 1A.

As shown in FIGS. 1A, 1B and 2, the resin coating layer 2*b* at an end portion of the electric wire 2 was peeled using a wire stripper to expose the aluminum alloy wire rod 2*a*. By inserting the thus-processed electric wire 2 into the barrel portion 3*b* of the terminal 3, and partially strongly compressing the barrel portion 3*b* using a crimper and an anvil, a portion of the electric wire 2 where the aluminum alloy wire rod 2*a* is exposed and a portion coated with the resin coating layer 2*b* were both crimped with the barrel portion 3*b* to manufactured the electric wire with terminal 1. The crimping was performed such that the compression factor (hereinafter referred to as a "coating compression factor") of a portion coated with the resin coating layer 2*b* was in a range of 70% to 90%.

The coating compression factor is an area ratio before and after the crimping of the resin coating layer 2*b* that is obtained by cutting the electric wire 2 after the crimping, specifically, the resin coating layer 2*b* and the crimp portion of between the barrel portion 3*b*, in a direction perpendicular to a longitudinal direction, measuring an area of the resin coating layer 2*b* in the obtained cross-section, and by determining a ratio with respect to the same area before crimping. A plurality of types of electric wire with terminals with different coating compression factors were manufactured, and an air leak test was performed on these electric wire with terminals 1 to test whether there is an air leak from a gap between the barrel portion and the electric wire. The air leak test was carried out by gradually increasing an air pressure applied on the electric wire with terminal 1 from an end portion of the electric wire 2 not connected to the terminal 3 such that an air pressure of 50 kPa is applied for 30 seconds and checking whether there is a leak, and after 120 hours have passed at 120° C., the leak was checked in a similar manner. The results are shown in Table 7.

TABLE 7

| | No. | Fill Factor % | Result of Air Leak Test |
|---|---|---|---|
| EXAMPLE | 1 | 98 | No Leak |
| | 30 | 98 | No Leak |
| | 50 | 99 | No Leek |
| COMPARATIVE EXAMPLE | 5 | 89 | Leak |

The results in Table 7 show that no air leak was observed under the condition of an air pressure of 50 kPa for any of the electric wires 1 of Examples 1, 30 and 50.

On the other hand, as a comparative example of the electric wire with terminal 1, a similar experiment was carried out using a wire rod (Comparative Example 5) composed of pure aluminum in place of the aluminum alloy wire rod 2*a*. The result is shown in Table 7.

The result shows that, with the electric wire with terminal of Comparative Example 5, the fill factor of the wire rod was only 89%, and the wire rod extended in a longitudinal direction by crimping. With reference to FIG. 2, the wire rod extended outwardly from an opening side of the barrel portion 3*b* and also extended toward a tip end side of the one-end closed tubular barrel portion 3*b*, in other words, inwardly of the barrel portion 3*b*, and the wire rod entered and reached to a position near the welded portion 4*b* that has been formed. Thereby, the welded overlapped section 5 or the welded portions 4*a* and 4*b* in the vicinity thereof that are weak in strength in the barrel portion 3*b* were pressed by the wire rod that has entered therein, and subjected to an excessive stress load and a crack was produced. Also, the entire electric wire was pushed back towards a rear end side, and the aluminum alloy wire rod without coating was exposed from the opening portion of the barrel portion. Further, even for those electric wire with terminals in which such defects were luckily not produced, due to a low fill factor of the wire rod, when an air leak test under the same condition as the Examples was performed, an air leak occurred between an air pressure of 1 to 5 kPa for all of the ten tests carried out.

Thereby, an effect of employing the aluminum alloy wire rod of the present embodiment with the terminal 3 having the one-end closed tubular barrel portion 3*b* is elucidated.

The electric wire with terminal of the present disclosure can be used as an electric wire with terminal for electric wiring body showing a high conductive property, a high bending fatigue resistance, an appropriate proof stress, and a high elongation property. Also, it is useful as a battery cable, a harness or conducting wire for motors, which are equipped on a transportation vehicle, or an electric wiring body of an industrial robot. Further, it can be preferably used in a door and a trunk, an engine hood or the like for which a high bending fatigue resistance is required.

What is claimed is:

1. An electric wire apparatus comprising:

an electric wire including an aluminum alloy wire rod having an outer periphery portion coated; and a crimp terminal that is crimped to an end portion of the electric wire, the crimp terminal having a barrel portion that is crimped with the aluminum alloy wire rod, the barrel portion having a one end closed tubular shape, wherein the aluminum alloy wire rod has a composition comprising 0.10 mass % to 1.00 mass % of magnesium (Mg), 0.10 mass % to 1.00 mass % of silicon (Si), 0.01 mass % to 2.50 mass % of iron (Fe), 0.000 mass % to 0.100 mass % of titanium (Ti), 0.000 mass % to 0.030 mass % of boron (B), 0.00 mass % to 1.00 mass % of copper (Cu), 0.00 mass % to 0.50 mass % of silver (Ag), 0.00 mass % to 0.50 mass % of gold (Au), 0.00 mass % to 1.00 mass % of manganese (Mn), 0.00 mass % to 1.00 mass % of chromium (Cr), 0.00 mass % to 0.50 mass % of zirconium (Zr), 0.00 mass % to 0.50 mass % of hafnium (Hf), 0.00 mass % to 0.50 mass % of vanadium (V), 0.00 mass % to 0.50 mass % of scandium (Sc), 0.00 mass % to 0.50 mass % of cobalt (Co), 0.00 mass % to 0.50 mass % of nickel (Ni), and the balance including aluminum and inevitable impurities.

2. The electric wire apparatus of claim 1, wherein an average crystal grain size at the outer peripheral portion of the aluminum alloy wire rod is 1 μm to 35 μm, and an average crystal grain size at an inner portion of the aluminum alloy wire rod is greater than or equal to 1.1 times the average crystal grain size at the outer peripheral portion.

3. The electric wire apparatus of claim 1, wherein the composition includes at least one element selected from a group consisting of Ti: 0.001 mass % to 0.100 mass % and B: 0.001 mass % to 0.030 mass %.

4. The electric wire apparatus of claim 1, wherein the aluminum alloy wire rod includes at least one element selected from a group consisting of Cu: 0.01 mass % to 1.00 mass %, Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass %, and Ni: 0.01 mass % to 0.50 mass %.

5. The electric wire apparatus of claim 1, wherein a sum of contents of Fe, Ti, B, Cu, Ag, Au, Mn, Cr, Zr, Hf, V, Sc, Co, and Ni in the aluminum alloy wire rod is 0.01 mass % to 2.50 mass %.

6. The electric wire apparatus of claim 1, wherein a number of cycles to fracture measured in a bending fatigue test is greater than or equal to 100,000 cycles and a conductivity is 45% IACS to 55% IACS.

7. The electric wire apparatus of claim 1, wherein a diameter of a wire of the aluminum alloy wire is 0.1 mm to 0.5 mm.

* * * * *